US008684704B2

(12) United States Patent
Raleigh et al.

(10) Patent No.: US 8,684,704 B2
(45) Date of Patent: Apr. 1, 2014

(54) RADIAL CAM-DRIVEN COMPRESSOR AND RADIAL CAM-DRIVEN COMPRESSOR ASSEMBLIES

(75) Inventors: Timothy Raleigh, Long Grove, IA (US); Sammy Mickelson, Bettendorf, IA (US); Robert Francois, DeWitt, IA (US); Scott H. Harvey, West Liberty, IA (US); Kevin Hurley, Davenport, IA (US)

(73) Assignee: Carleton Life Support Systems, Inc., Davenport, IA (US)

( * ) Notice: Subject to any disclaimer, the term of this patent is extended or adjusted under 35 U.S.C. 154(b) by 0 days.

(21) Appl. No.: 12/809,624

(22) PCT Filed: Dec. 19, 2008

(86) PCT No.: PCT/US2008/087591

§ 371 (c)(1),
(2), (4) Date: Jun. 21, 2010

(87) PCT Pub. No.: WO2009/086051

PCT Pub. Date: Jul. 9, 2009

(65) Prior Publication Data

US 2010/0272585 A1 Oct. 28, 2010

Related U.S. Application Data

(60) Provisional application No. 61/016,131, filed on Dec. 21, 2007.

(51) Int. Cl.
*F04B 1/04* (2006.01)
*F04B 27/04* (2006.01)

(52) U.S. Cl.
USPC ..... 417/273; 417/313; 92/139; 74/567

(58) Field of Classification Search
USPC ..... 417/256, 266, 273, 313; 55/385.3, 490; 92/139, 78, 72, 129; 74/567–569
See application file for complete search history.

(56) References Cited

U.S. PATENT DOCUMENTS

| | | | | |
|---|---|---|---|---|
| 1,229,009 | A | | 6/1917 | Allison |
| 2,198,552 | A | | 4/1940 | Rieger |
| 2,444,159 | A | | 6/1947 | Godfriaux |
| 3,344,715 | A | * | 10/1967 | Wilson ..... 91/498 |
| 3,830,264 | A | | 8/1974 | Billett et al. |

(Continued)

FOREIGN PATENT DOCUMENTS

| | | |
|---|---|---|
| JP | 2001088094 | 4/2001 |
| WO | 2005033506 | 4/2005 |
| WO | 2007019452 A2 | 2/2007 |

OTHER PUBLICATIONS

Air Systemes International Inc. Manual Number HP 4009. Nov. 4, 2004. TA3-AXAF Intrinsically Safe Compressor. Air Systems International, Inc, Chesapeake, VA 22320.*

*Primary Examiner* — Devon Kramer
*Assistant Examiner* — Joseph Herrmann
(74) *Attorney, Agent, or Firm* — Katherine H. McGuire, Esq.; Woods Oviatt Gilman LLP

(57) ABSTRACT

A first aspect of the invention includes a multi-stage gas compressor having a central cam with a plurality of pistons operably connected to and radially extending from the central cam. The cam follower assemblies each include a roller element connected to a roller bracket which rides within and along a guide channel defines by facing grooves formed in housing end plates.

4 Claims, 5 Drawing Sheets

(56) References Cited

U.S. PATENT DOCUMENTS

| | | | | |
|---|---|---|---|---|
| 4,522,110 | A * | 6/1985 | Samuelsson | 91/488 |
| 4,658,798 | A | 4/1987 | Yogo et al. | |
| 4,712,518 | A | 12/1987 | Johnson | |
| 4,948,401 | A * | 8/1990 | Izumi et al. | 96/115 |
| 5,078,580 | A * | 1/1992 | Miller et al. | 417/265 |
| 5,470,535 | A * | 11/1995 | Ray et al. | 422/534 |
| 6,074,177 | A * | 6/2000 | Kobayashi et al. | 417/313 |
| 6,328,536 | B1 | 12/2001 | Zebuhr | |
| 6,422,830 | B1 * | 7/2002 | Yamada et al. | 417/222.2 |
| 7,776,118 | B2 * | 8/2010 | Min et al. | 55/385.1 |
| 8,011,897 | B2 * | 9/2011 | Raleigh et al. | 417/271 |
| 2005/0120984 | A1 | 6/2005 | Kuhn | |
| 2007/0140871 | A1 * | 6/2007 | Bond | 417/273 |

* cited by examiner

RADIAL CAM-DRIVEN COMPRESSOR AND RADIAL CAM-DRIVEN COMPRESSOR ASSEMBLIES

RELATED APPLICATION DATA

This application claims the benefit of prior provisional application U.S. Ser. No. 61/016,131 filed Dec. 21, 2007.

BACKGROUND OF THE INVENTION

The present invention relates to compressors and, in a first aspect thereof, more particularly relates to a compressor having a central cam with one or more pistons and respective cam follower assemblies operatively connected to and radially extending from the centrally located cam. In another aspect, the invention relates to a compressor including a filter and filter retainer plate positioned between the compression chamber of the cylinder and outlet port of the cylinder head. In yet another aspect, the invention relates to a compressor including a cam follower assembly having a roller element and guide bracket which is located for reciprocal movement within a respective guide channel defined by a pair of facing grooves formed in compressor housing plates.

Electrically driven compressors must convert rotary motion from a motor into linear motion to actuate a piston or a series of pistons to generate compressed gas. Most gas compressors accomplish this task by means of a crankshaft and connecting rod assembly similar to that found in internal combustion engines. Some advantages to this design are the proven reliability and the high operating efficiency. One major disadvantage is the space required by the connecting rod throughout a complete rotation of the crankshaft. This disadvantage becomes particularly evident in multistage compressors used for compressing gas to high pressures, typically greater than 1000 psig. Often, the higher-stage pistons cannot accommodate the connecting rod and the dynamic space it occupies. As a result, many designs limit the piston travel to under 0.5 inches, and used stepped pistons in the higher pressure stages. These actions reduce the compressor efficiency and add components to the assembly.

Other designs for compressors utilize nutating heads to convert rotary motion into linear motion. In these designs, the piston travel is parallel to the axis of rotation. Automotive air conditioning compressors commonly use this type of compressor. An advantage of this style compressor is the low amount of package space required by the compressor. In addition, the connecting rods articulate less than those used with crankshafts. This allows more travel in small diameter pistons than with crankshaft designs. One disadvantage to this style of compressor is the piston reciprocation relies mostly on sliding action than on rolling action. This increases the amount of friction in the system, lowers overall compressor efficiency, and requires continuous lubrication to achieve reliable compressor performance.

SUMMARY OF THE INVENTION

The present invention addresses the shortcomings of the prior art by providing in a first aspect a compressor having a central cam to actuate pistons arranged in a radial fashion about the cam. The compressor assembly includes a housing comprising an annular block having annularly spaced cylinder mounting surfaces. A cam 16 is positioned near or at the center of housing and connects to motor and speed reducer via a central shaft extending along an axis. First, second and third stage cylinder and piston assemblies radially extend from and are operably connected via respective cam follower assemblies to the cam.

In one embodiment, the invention provides a radial cam-driven compressor comprising:

a) a housing having a central opening and a plurality of radially extending bore holes formed in annularly spaced relation about and through said housing;

b) a cam rotatably mounted on a camshaft extending through said housing central opening;

c) a plurality of cylinder and piston assemblies with each said piston located and movable within a respective said cylinder; and d) a plurality of cam follower assemblies each including a roller element rotatably connected to a roller bracket and a connecting rod having first and second ends, each said connecting rod extending along a respective radial axis through a respective said bore hole in said housing, each said connecting rod first end connected to a respective said roller bracket located within said housing central opening, each said connecting rod second end connected to a respective said piston located outside said housing central opening, said roller element of each of said cam follower assemblies being in rolling contact with said cam, whereby rotation of said cam is operable to sequentially reciprocate each of said rollers and respective connecting rods and piston and cylinder assemblies positioned in annularly spaced relation about said housing.

The radial cam-driven compressor may be a three-stage compressor comprising first, second and third cylinder and piston assemblies sequentially compressing air through low, medium and high relative compressions, respectively.

The radial cam-driven compressor may further comprise first and second housing plates positioned in spaced, parallel relation about the housing central opening with the cam positioned between the first and second housing plates, the plates each having an aligned central opening wherethrough the cam shaft extends along an axis extending substantially perpendicular to each of the radially extending axes of the connecting rods of the cam follower assemblies.

The first and second housing plates may each further include a plurality of annularly spaced, radially extending grooves with the channels in the first plate aligned in facing relation to the grooves in the second plate, each pair of facing grooves forming a guide channel wherein a respective one of the cam follower assemblies is located for reciprocal, sliding movement therein.

The cam follower assemblies may each further include a pair of end plates attached on opposite sides of a respective roller bracket, the pair of end plates received in closely fitting, sliding engagement within the guide channel of a respective pair of facing grooves.

In a second aspect of the invention, a cam-driven compressor is provided including a housing, a cam and a plurality of cylinder and piston assemblies with said piston located and movable within a respective cylinder, wherein the improvement comprises:

a) a plurality of cam follower assemblies each including a roller element rotatably connected to a roller bracket having first and second, spaced end plates, and a connecting rod having first and second ends, each connecting rod first end connected to a respective roller bracket, each connecting rod second end connected to a respective piston, the roller element of each cam follower assembly being in rolling contact with the cam, and first and second housing plates positioned in spaced, parallel relation to the housing with the first and second housing plates each including a plurality of grooves aligned in facing relation to each other, each pair of facing grooves defining a guide channel, whereby a pair of end plates are received in closely fitting, sliding engagement within a respective guide channel whereby rotation of the cam is operable to reciprocate each of the cam follower assemblies in a respective said guide channel. This aspect of the invention may be part of a radial compressor as described above in the first aspect of the invention, or in a linear compressor such as described in co-pending application Ser. No. 11/997,970, the entire disclosure of which is incorporated herein by reference.

In a third aspect of the invention, a cam-driven compressor including a plurality of cylinder and piston assemblies is provided with each piston located and movable within a respective cylinder, each piston and cylinder pair defining a gas compression chamber within a respective cylinder, and a cylinder head for mounting to each cylinder, each cylinder head including a gas inlet port and gas outlet port, wherein the improvement comprises a filter and filter retainer plate positioned between the gas compression chamber and gas outlet port. The filter retainer plate advantageously also serves to reduce dead space between the piston and the outlet port of the cylinder head which increases the operating efficiency of the compressor. As with the second aspect of the invention, this aspect of the invention may be part of a radial compressor as described above in the first aspect of the invention, or in a linear compressor such as described in co-pending application Ser. No. 11/997,970.

DETAILED DESCRIPTION OF A PREFERRED EMBODIMENT

Figure 1:
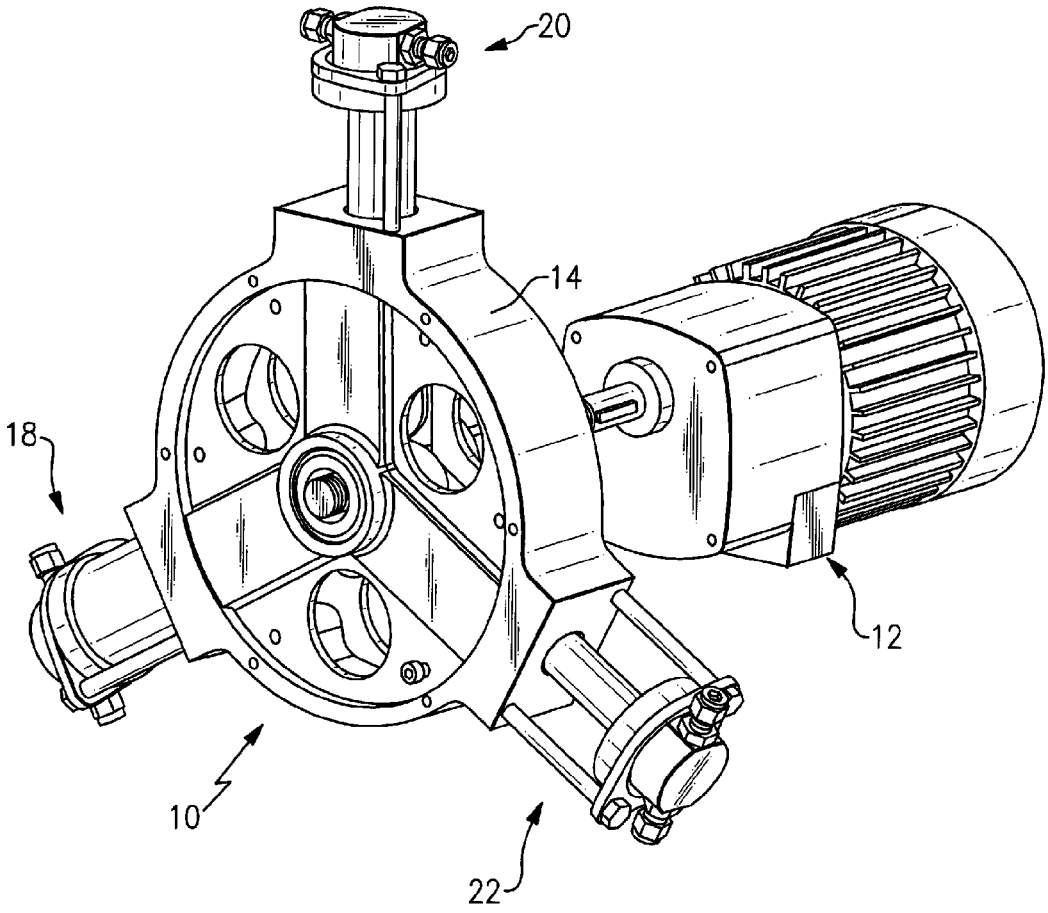
FIG. 1 is a perspective view of one embodiment of a compressor assembly of the invention.
Figure 2:
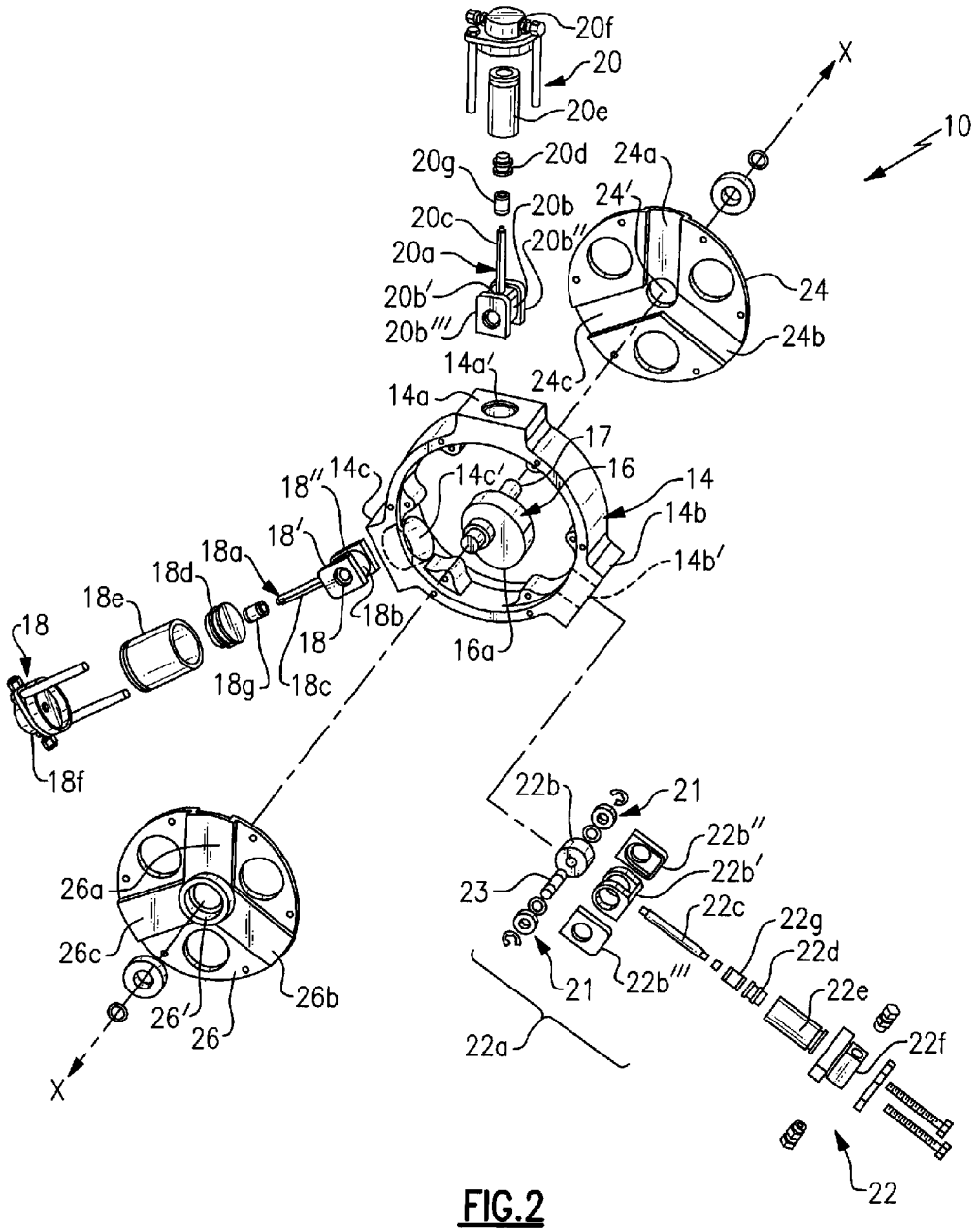
FIG. 2 is an exploded view of a portion thereof.

Referring to the drawing, there is seen in FIGS. 1 and 2 one embodiment of the inventive compressor assembly designated generally by the reference numeral 10. Compressor assembly 10 is configured to connect to a motor and speed reducer 12. As seen best in FIG. 2, compressor assembly 10 includes a housing 14 comprising an annular block having annularly spaced mounting surfaces 14*a-c*. A cam 16 is positioned near or at the center of housing 14 and connects to motor and speed reducer 12 via central shaft 17 extending along axis X-X. First, second and third stage cylinder and piston assemblies 18, 20 and 22, respectively, are spaced 120° apart and radially extend along respective axes $Y\text{-}Y_{1\text{-}3}$ from and are operably connected via respective cam follower assemblies 18*a*, 20*a* and 22*a* to cam 16 as described more fully below. Cam axis X-X extends substantially perpendicular to axes $Y\text{-}Y_{1\text{-}3}$ along which the respective cam follower assemblies 18*a*, 20*a* and 22*a* extend.

Each cam follower assembly includes a respective roller element 18*b*, 20*b* and 22*b* rotatably connected between respective roller brackets 18*b'*, 20*b'* and 22*b'* and associated end plates 18*b''*, 18*b'''*, 20*b''*, 20*b'''* and 22*b''*, 22*b'''*. In the preferred embodiment, the roller elements 18*b*, 20*b* and 22*b* are constructed from advanced polymers. These materials have demonstrated the ability to carry high loads without needing continuous lubrication to prevent surface wear. Where prior art designs used a fixed support pin and cam follower bearing as the roller element, the present invention preferably uses side bearings (see parts 21 in FIG. 2) in the follower body to support the rotating pin 23 used to locate the respective roller element.

Each cam follower assembly further includes a respective connecting rod 18*c*, 20*c* and 22*c* connected to a respective roller element 18*b*, 20*b* and 22*b* via a respective roller bracket at a first end thereof; and to a respective piston 18*d*, 20*d* and 22*d* at a second end thereof. Each connecting rod telescopes within a respective linear bearing 18*g*, 20*g* and 22*g*. Each piston 18*d*, 20*d* and 22*d* is reciprocally located in a respective cylinder 18*e*, 20*e* and 22*e*. A compressor head 18*f*, 20*f* and 22*f* mounts to the end of a respective cylinder opposite the end from which the respective connecting rod extends. Although not individually labeled, appropriate sub-components (e.g., seals, bushings, bearings and washers, etc.), are provided within the completed assembly.

Housing plates 24, 26 are provided which mount to opposite sides of housing 14 and include aligned centrally located holes 24', 26' through which cam shaft 17 extends. Plates 24, 26 each further include a plurality of grooves 24*a-c* and 26*a-c* which align and face each other in spaced relation in the assembled condition to form guide channels in which the respective cam followers and connecting rods/linear bearings reciprocate.

It is noted that prior art axial cam designs used a ball bearing mounted on the outside of the follower body. These bearings were guided by linear slots machined into the compressor housing. The linear cam design utilized guide rings mounted on the follower body that were guided by large bores machined into the compressor body. Each of these approaches resulted in high contact stresses and non-optimal support of the follower body.

The present invention utilizes roller brackets 18*b'*, 20*b'* and 22*b'* and associated end plates 18*b''*, 18*b'''*, 20*b''*, 20*b'''* and 22*b''*, 22*b'''* which are supported by large paired grooves 24*a-c* and 26*a-c*, respectively, machined into housing plates 24, 26, respectively. These brackets distribute the cam side loading over a large area. In addition, the guide brackets are centered over the cam roller centerline. The combined effect of the larger contact area and centered location result in lower contact stresses and better follower support. Follower support is also less sensitive to roller bracket and manufacturing tolerances. It will furthermore be appreciated that the low friction design of the cam follower assemblies of the present invention reduces the need for lubricating agents which in turn reduces cost and the potential for particulate contamination.

In the embodiment of FIG. 2, each connecting rod and respective piston are not rigidly connected to each other (i.e., one simply abuts the other). As such, secondary support for the followers may be provided by linear bushings 18*g*, 20*g*, 22*g* mounted in the compressor housing. These bushings contact the outer surface of their respective connecting rods and ensure the connecting rod remains centered in the respective cylinder. This is particularly important for the third stage piston assembly 22 where the amount of clearance between the connecting rod and the cylinder is low. Advantages of using linear bearings include piston side load reduction which can extend seal life, more design options and lower sensitivity to manufacturing tolerances.

While linear bearings provide a number of advantages as explained above, they may not be desirable from a cost perspective. In an alternate embodiment seen in FIG. 3, linear bearings are not used. In this embodiment, a solid connection (e.g., threaded) is provided between the connecting rod and respective piston whereby the piston helps support and guide the respective follower assembly. As such, linear bearings are not necessary in this embodiment.

Figure 3:
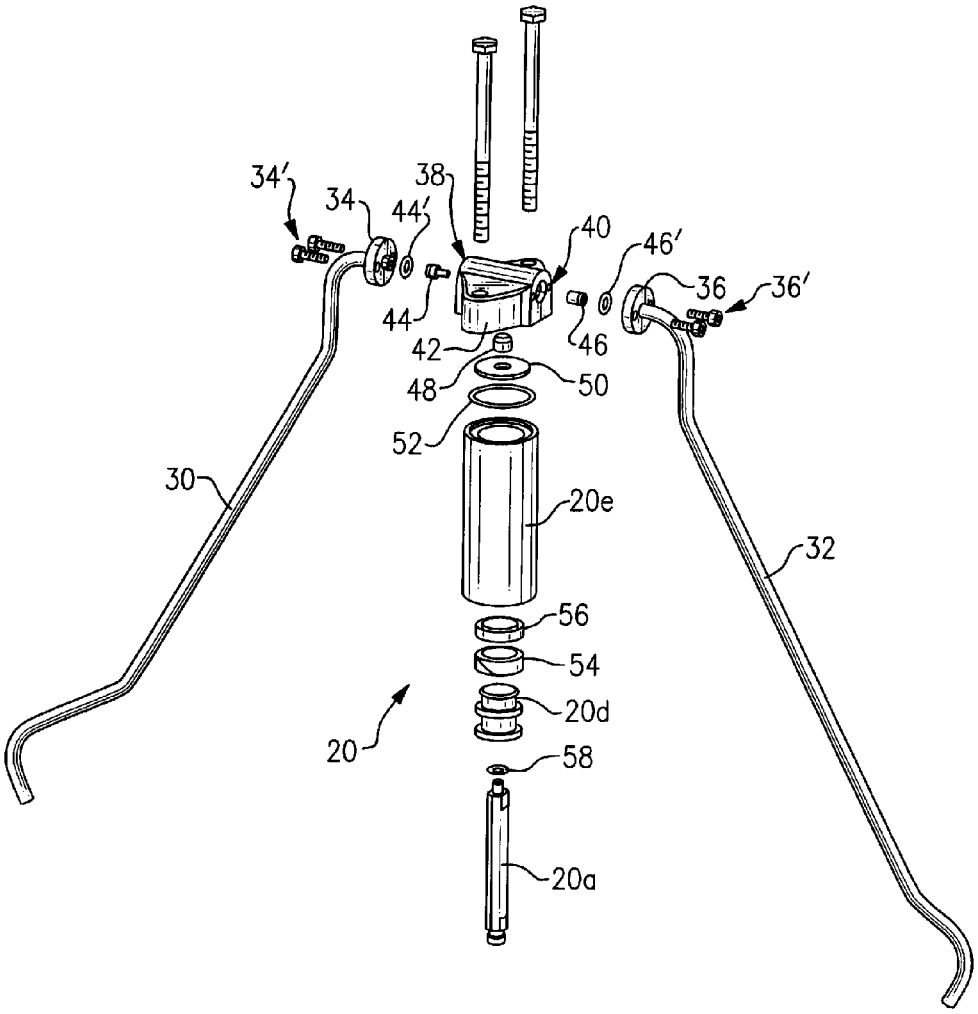
FIG. 3 is an exploded view of a cylinder and piston assembly thereof.

The cylinder heads 18*f*, 20*f* and 22*f* of FIGS. 1 and 2 include respective fittings 18*e*, 20*e* and 22*e* for attaching air lines (not shown in FIGS. 1 and 2) using a compression type fitting. FIG. 3 illustrates an alternate embodiment of cylinder head 42 having inlet and outlet ports 38, 40 to which air tubing 30, 32 is connected via respective flanges 34, 36 and bolts 34', 36'. It is understood the embodiment of cylinder head 42 and air tubing of FIG. 3 may be incorporated at the other two cylinder and piston assemblies 18, 22.

Figure 4:
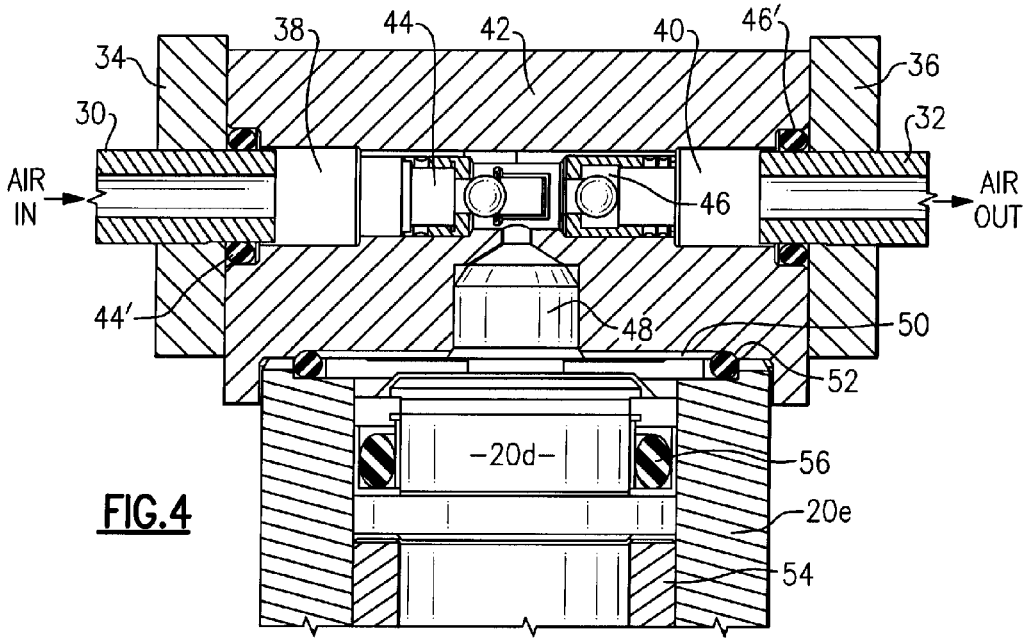
FIG. 4 is a cross-sectional view of a cylinder and head assembly.

Still referring to FIG. 3, check valves 44, 46 and associated O-rings 44', 46' mount within inlet and outlet ports 38, 40 to ensure air flow through the cylinder and piston assembly in the correct direction, i.e., from air tube 30 to air tube 32. A filter element 48 may be mounted with a filter retainer plate 50 and O-ring 52 within head 42 to prevent seal wear particles from reaching the check valves 44, 46 which could cause leaks (see also FIG. 4). It is noted filter retainer plate 50 also reduces the dead space between the piston and cylinder head at the top of the piston stroke. Reducing piston/cylinder dead space is beneficial in that it improves compressor efficiency and reduces internal loads in the compressor.

Figure 5:
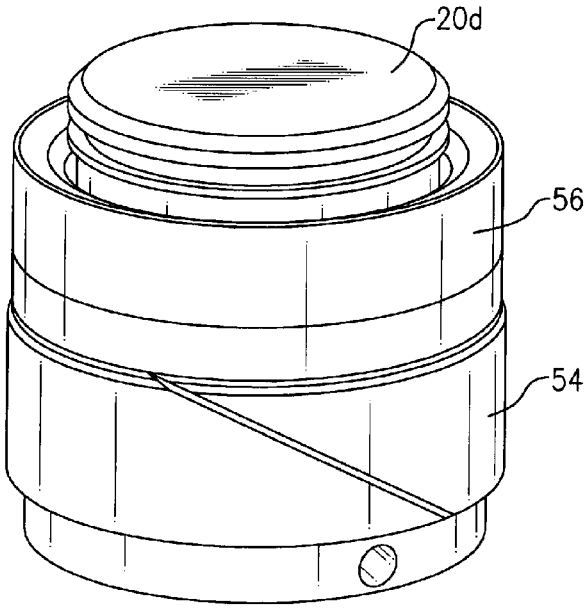
FIG. 5 is a perspective view of a piston.

A guide ring 54 and seal 56 may also be provided for mounting to piston 20*d* (see also FIG. 5). A shim washer 58 may also be provided to adjust the clearance between the piston and cylinder head to, for example, between about 0.010 and 0.025 inches.

Figure 6A:
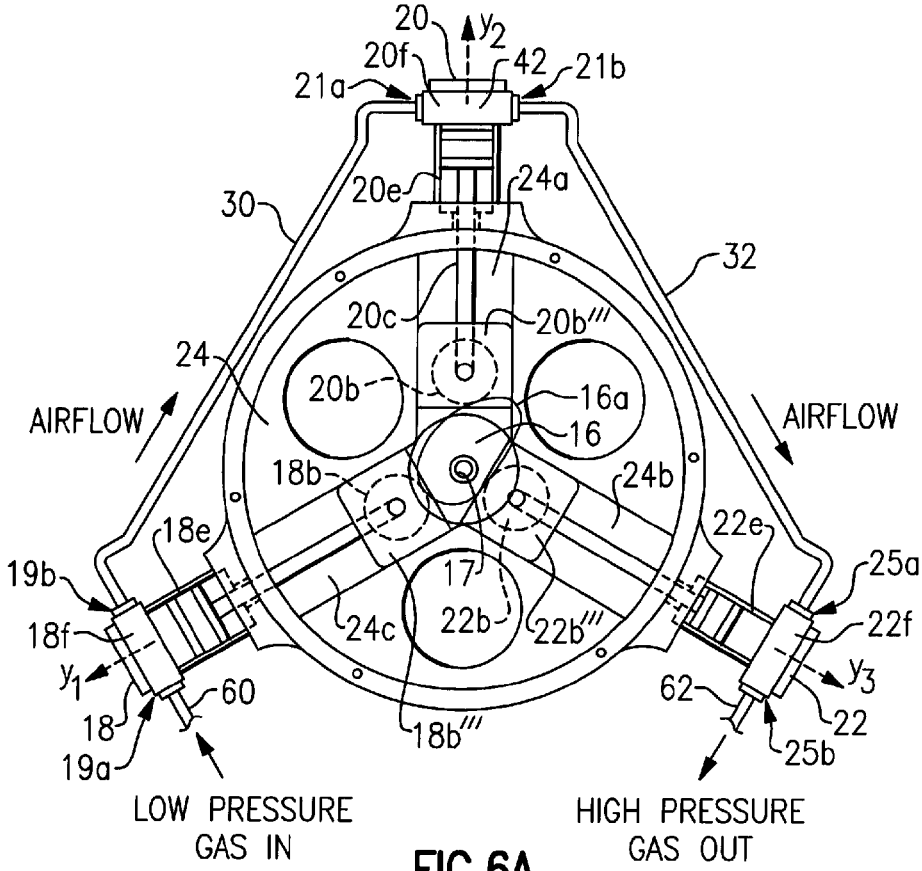
FIG. 6A is plan view of a compressor assembly with the front end plate removed and having an alternate embodiment of the cylinder head and air line connection.
Figure 6B:
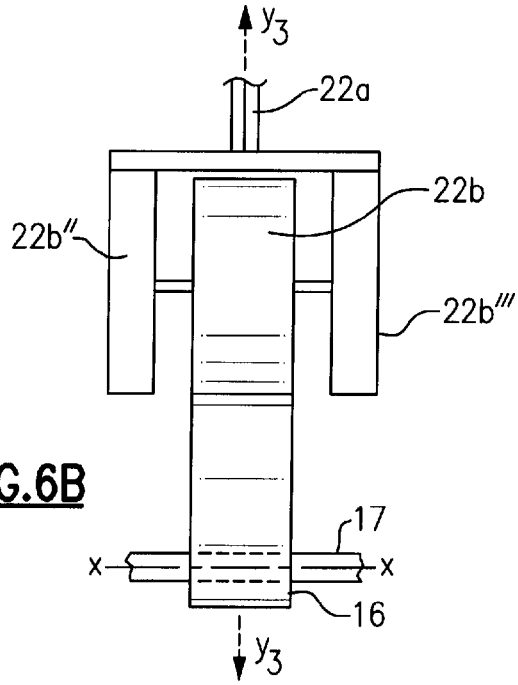
FIG. 6B is an enlarged, plan view of one of the cam and cam followers shown in FIG. 6A.

Referring to FIGS. 6A and 6B, an embodiment of compressor 10 is illustrated in the assembled condition with the front end plate 26 removed. Low pressure gas enters via an air tube 60 into first stage cylinder and piston assembly 18 via inlet port 19*a* thereof and enters cylinder 18*e*. When the highest lobe point 16*a* of cam 16 reaches assembly 18, roller 18*b* rides along lobe point 16*a* resulting in a piston upstroke (toward head 180 and a first stage compression of the gas within cylinder 18*e*. During the upstroke, end plates 18", 18'" ride within and along the guide channel defined by facing grooves 24*c* and 26*c* (plate 26 not shown in FIG. 6A). The compressed gas exits head 18 at outlet port 19*b* and is directed through air tube 30 until it reaches head 20*f* wherein the first stage compressed gas enters through inlet port 21*a* into cylinder 20*e*. At this time, piston 20*d* begins a downstroke position as the gas enters its respective compression chamber. As cam 16 continues to rotate in the counter-clockwise direction, the medium point of cam 16 approaches cam follower assembly 20 which then begins its upstroke. High lobe point 16*a* next approaches assembly 20 which completes the second stage compression of the gas within cylinder 20*e*. During the upstroke, end plates 20", 20'" ride along and within the guide channel defined by facing grooves 24*a*, 26*a*. The compressed gas exits at outlet port 21*b* and is directed through air tube 32 until it reaches head 22*f* wherein the second stage compressed air enters through inlet port 25*a* into cylinder 22*e*. As cam 16 continues to rotate in the counter-clockwise direction, the medium lobe point of cam 16 approaches roller assembly 22 which begins its upstroke. Roller 22*b* then rides along lobe high point 16*a* resulting in a full piston upstroke and a third stage compression of the gas within cylinder 22*e*. During the upstroke, end plates 22*b"*, 22*b'"* ride along and within the guide channel defined by facing grooves 24*b*, 26*b*. The compressed gas exits as high pressure air (e.g., up to or exceeding 1000 psi), via outlet port 25*b* through air tube 62 which may be connected to an appropriate high pressure gas collection (e.g., air cylinder, not shown). As rotation of cam 16 continues, this cycle is repeated providing a continuous stream of high pressure gas at outlet port 25*b*.

It will thus be appreciated the present invention provides a cam driven radial compressor. Although three stages of compression are shown, it is understood that any number of compression stages including one may be used in accordance with the teachings of the present invention. It is further understood that variations may be made to the present invention as understood by those skilled in the art without departing from the full spirit and scope of the invention as defined by the claims which follow.

What is claimed is:

1. A cam-driven compressor including:

a housing, a cam and a plurality of cylinder and piston assemblies wherein each said cylinder and piston assembly comprises a piston located and movable within a respective cylinder, wherein the improvement comprises:

a plurality of cam follower assemblies each including a roller element rotatably connected to a roller bracket which is mounted between generally rectangular first and second, spaced end plates, and a connecting rod having first and second ends, wherein each said connecting rod first end is connected to a respective said roller bracket, each said connecting rod second end is connected to a respective said piston, said roller element of each of said cam follower assemblies being in rolling contact with said cam; and first and second housing plates positioned in spaced, parallel relation to said housing with said first and second housing plates each including a plurality of integral grooves aligned in facing relation to each other, each pair of integral facing grooves defining a linear guide channel, whereby the entirety of each respective cam follower assembly is contained within a respective linear guide channel and each of said generally rectangular first and second end plates of each respective cam follower assembly are received in closely fitting, sliding engagement within said respective linear guide channel.

2. The improvement of claim 1, wherein each said cylinder and piston assembly define a gas compression chamber within the cylinder and including a cylinder head for mounting to each cylinder, each cylinder head including a gas inlet port and gas outlet port, wherein the improvement further comprises a filter and filter retainer plate positioned between the gas compression chamber and the gas outlet port of the cylinder head of each cylinder and piston assembly.

3. The improvement of claim 2 wherein said cylinder and piston assemblies are arranged in radially spaced fashion about a centrally located cam.

4. The improvement of claim 1, wherein each said cylinder and piston assembly includes a cylinder head which mounts to the cylinder, each said cylinder head including a gas inlet port and gas outlet port, and a gas compression chamber defined within each said cylinder and piston assembly, wherein a filter and filter retainer plate are positioned between the gas compression chamber and the gas outlet port of the cylinder head of each cylinder and piston assembly, wherein said filter retainer plate is positioned between the cylinder and the cylinder head of each said cylinder and piston assembly and thereby reducing dead space between said piston and said cylinder head.

* * * * *